US011445792B1

(12) United States Patent
Walters

(10) Patent No.: US 11,445,792 B1
(45) Date of Patent: Sep. 20, 2022

(54) HAIR DRY BLOWER

(71) Applicant: Sheryl-Lee Walters, Buckinghams (GB)

(72) Inventor: Sheryl-Lee Walters, Buckinghams (GB)

( * ) Notice: Subject to any disclaimer, the term of this patent is extended or adjusted under 35 U.S.C. 154(b) by 284 days.

(21) Appl. No.: 16/882,826

(22) Filed: May 26, 2020

(51) Int. Cl.
*A45D 20/50* (2006.01)
*A45D 20/12* (2006.01)

(52) U.S. Cl.
CPC ..... *A45D 20/12* (2013.01)

(58) Field of Classification Search
CPC . A45D 20/12; A45D 1/00; A45D 2/00; A45D 2/42; A45D 6/12; A45D 20/50; A45D 20/52
See application file for complete search history.

(56) References Cited

U.S. PATENT DOCUMENTS 2,688,971 A 9/1954 Daniels et al.
5,526,578 A 6/1996 Iyer
6,070,596 A * 6/2000 Altamore ..... A45D 1/06 132/229
6,782,636 B2 * 8/2004 Feldman ..... A45D 20/50 392/383
8,915,256 B2 * 12/2014 Klava ..... A45D 2/36 132/224
9,012,813 B2 * 4/2015 Mourad ..... A45D 1/04 132/224
D808,658 S 1/2018 Sophie
2010/0089413 A1 4/2010 Wright et al.
2011/0056509 A1 * 3/2011 Benest ..... A45D 20/10 132/223
2017/0095050 A1 * 4/2017 Dineen ..... A45D 20/12
2018/0055188 A1 3/2018 Potts et al.

FOREIGN PATENT DOCUMENTS

KR 2021050069 * 5/2021
WO WO2021019239 * 2/2021

* cited by examiner

*Primary Examiner* — Gregory A Wilson
(74) *Attorney, Agent, or Firm* — Kyle A. Fletcher, Esq.

(57) ABSTRACT

The hair dryer blower comprises a base, a first paddle, and a second paddle. The first and second paddle may be moved to an open position and the hair may be placed between the paddled. The first and second paddle may be pivoted to a closed position such that the hair passes between the paddles. A heating fan located within the base may draw ambient air across a heating element and may force heated air out of the first paddle and through the hair. The heated air may pass through the hair and may dry the hair. Moist air produced as the heated air passes through the hair may enter the second paddle. In some embodiments, the moist air may be drawn through the second paddle by a cooling fan in the base and may be expelled via an air exhaust port.

19 Claims, 8 Drawing Sheets

HAIR DRY BLOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hair care, more specifically, a hair dryer blower.

SUMMARY OF INVENTION

The hair dryer blower comprises a base, a first paddle, and a second paddle. The first and second paddle may be moved to an open position and the hair may be placed between the paddled. The first and second paddle may be pivoted to a closed position such that the hair passes between the paddles. A heating fan located within the base may draw ambient air across a heating element and may force heated air out of the first paddle and through the hair. The heated air may pass through the hair and may dry the hair. Moist air produced as the heated air passes through the hair may enter the second paddle. In some embodiments, the moist air may be drawn through the second paddle by a cooling fan in the base and may be expelled via an air exhaust port.

An object of the invention is to dry hair,

Another object of the invention is to provide two pivoting paddles that the hair to be dried may be placed between.

A further object of the invention is draw ambient air into the base using a heating fam and to pass the ambient air over a heating element to produce heated air which may be blown of the first paddle to dry the hair.

Yet another object of the invention is to draw the most air produced by drying the hair into the second paddle using a cooling fan and to expel the moist air from the base.

These together with additional objects, features and advantages of the hair dryer blower will be readily apparent to those of ordinary skill in the art upon reading the following detailed description of the presently preferred, but nonetheless illustrative, embodiments when taken in conjunction with the accompanying drawings.

In this respect, before explaining the current embodiments of the hair dryer blower in detail, it is to be understood that the hair dryer blower is not limited in its applications to the details of construction and arrangement of the components set forth in the following description or illustration. Those skilled in the art will appreciate that the concept of this disclosure may be readily utilized as a basis for the design of other structures, methods, and systems for carrying out the several purposes of the hair dryer blower.

It is therefore important that the claims be regarded as including such equivalent construction insofar as they do not depart from the spirit and scope of the hair dryer blower. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
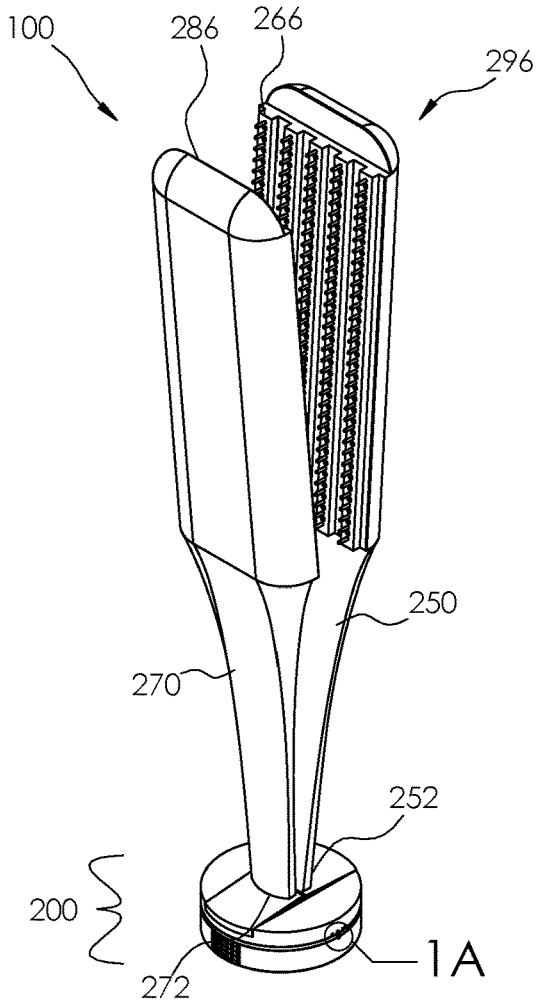
FIG. 1 is an isometric view of an embodiment of the disclosure illustrating the paddles in the open position.
Figure 2:
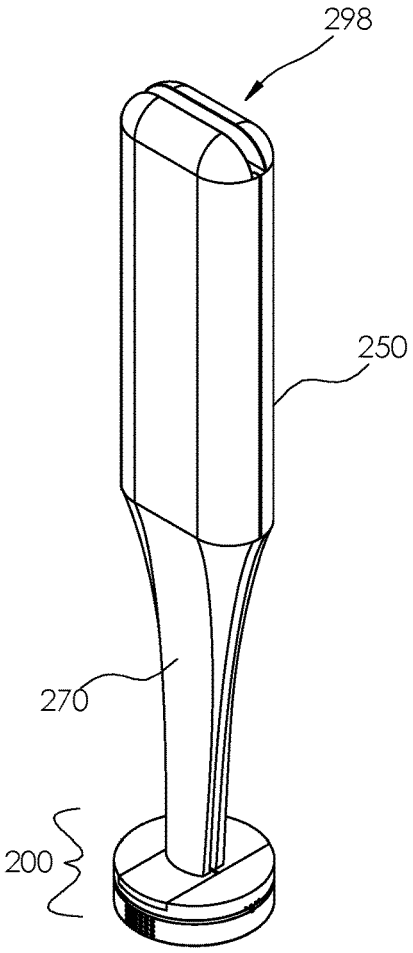
FIG. 2 is an isometric view of an embodiment of the disclosure illustrating the paddles in the closed position.
Figure 1A:
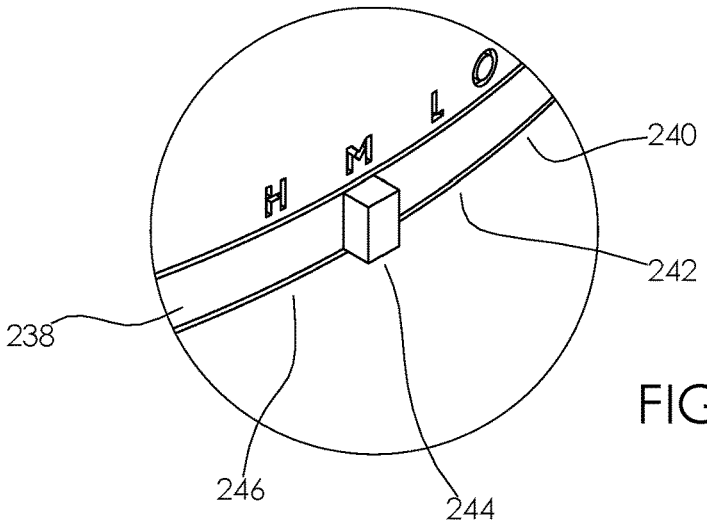
FIG. 1A is a detail view of an embodiment of the disclosure illustrating the area marked 1A in FIG. 1.
Figure 3:
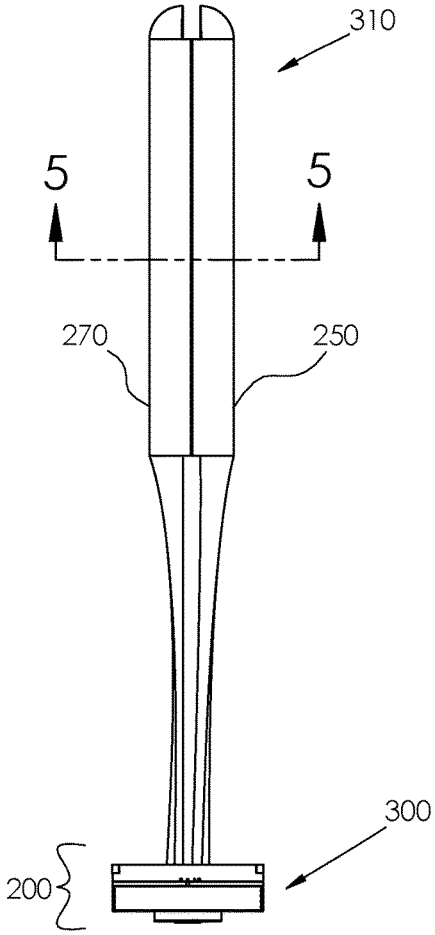
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 11.

The hair dryer blower 100 (hereinafter invention) comprises a base 200, a first paddle 250, and a second paddle 270. The invention 100 may dry hair 900. The first paddle 250 and the second paddle 270 may be moved to an open position 296 and the hair 900 may be placed between the first paddle 250 and the second paddle 270. The first paddle 250 and the second paddle 270 may be pivoted to a closed position 298 such that a first face 266 on the first paddle 250 is brought adjacent to a second face 286 on the second paddle 270 with the hair 900 passing between the first paddle 250 and the second paddle 270. A heating fan 204 located within the base 200 may draw ambient air across a heating element 202 and may force heated air out of the first paddle 250 and through the hair 900. The heated air may pass through the hair 900 and may dry the hair 900. Moist air produced as the heated air passes through the hair 900 may enter the second paddle 270. In some embodiments, the moist air may be drawn through the second paddle 270 by a cooling fan 206 in the base 200 and may be expelled via an air exhaust port 234.

Throughout this document positional references may be given in terms of a proximal end 300 of the invention 100 and a distal end 310 of the invention 100. The proximal end 300 of the invention 100 is defined to be the end of the invention 100 that is closest to a user 950. The distal end 310 of the invention 100 is defined to be the end of the invention 100 that is farthest away from the user 950.

The base 200 may comprise the heating element 202, the heating fan 204, the cooling fan 206, an operational control 208, and an enclosure. The base 200 may be pivotably coupled to the proximal end 300 of the first paddle 250 via a first pivot 214 and may be pivotably coupled to the proximal end 300 of the second paddle 270 via a second pivot 218.

The heating element 202 may convert electrical energy into heat. As non-limiting examples, the heating element 202 may comprise resistance wires made of metallic alloys such as nickel/chromium, iron/chromium/aluminum, or copper/nickel, ceramic or semiconductor elements such as molybdenum disilicide or silicon carbide, PTC ceramic elements, PTC polymer elements, or combinations thereof. The amount of heating produced by the heating element 202 may vary based upon one or more characteristics of the electrical energy applied to the heating element 202. As non-limiting examples, the heating element 202 may heat proportionally with the voltage, amperage, or frequency of the electrical energy applied to the heating element 202. The heating element 202 may be located inside of the enclosure and oriented such that the ambient air is pulled across the heating element 202 by the cooling fan 206 and produces the heated air that is forced into the first paddle 250.

The heating fan 204 may be mounted inside of the enclosure. The heating fan 204 may force the movement of the ambient air. The heating fan 204 may be electromechanical in nature. As non-limiting examples, the heating fan 204 may be a fan or a blower. The heating fan 204 may draw the ambient air in through an air intake port 232. The heating fan 204 may pull the ambient air across the heating element 202 thus creating the heated air. The heating fan 204 may expel the heated air from the base 200 into the first paddle 250 via a first base aperture 216.

The cooling fan 206 may be mounted inside of the enclosure. The cooling fan 206 may force the movement of the moist air. The cooling fan 206 may be electromechanical in nature. As non-limiting examples, the cooling fan 206 may be a fan or a blower. The cooling fan 206 may draw the moist air in through a second base aperture 220. The cooling fan 206 may expel the moist air via the air exhaust port 234.

A divider 236 may separate air paths within the base 200 such that the flow of the moist air through the base 200 from the second paddle 270 to the air exhaust port 234 is segregated from the flow of the ambient air into the air intake port 232 of the base 200, across the heating element 202, and into the first paddle 250 as the heated air.

The operational control 208 may be an electrical control that determines whether or not electrical energy reaches the heating fan 204, the cooling fan 206 and the heating element 202. The operational control 208 may comprise one or more speed settings. The operational control 208 may determine the speed of the heating fan 204, the speed of the cooling fan 206, the degree of heating of the heating element 202, or combinations thereof. As a non-limiting example, the operational control 208 may be a combination switch and variable resistance, such as a rheostat or potentiometer.

The enclosure may comprise a fan holder 230, a fan cover 212, and a control ring 238. The enclosure may house and protect the cooling fan 206, the heating fan 204, the heating element 202, and the operational control 208.

The fan holder 230 may be the proximal end 300 of the base 200. The cooling fan 206, the heating fan 204, and the heating element 202 may be coupled to the interior of the fan holder 230. The distal end 310 of the fan holder 230 may be open when not covered by the fan cover 212. The fan holder 230 may comprise the divider 236, the air intake port 232, and the air exhaust port 234. The air intake port 232 may be one or more apertures through the fan holder 230 located on the side of the fan holder 230 that feeds the heated air into the first paddle 250. The air exhaust port 234 may be one or more apertures through the fan holder 230 located on the side of the fan holder 230 that draws the moist air from the second paddle 270.

The fan cover 212 may couple to the distal end 310 of the fan holder 230 to seal the fan holder 230. The fan cover 212 may comprise the first pivot 214 and the second pivot 218. The first paddle 250 may couple to the first pivot 214 such that the first paddle 250 may pivot between the closed position 298 and the open position 296. The first pivot 214 may comprise the first base aperture 216 to allow the heated air to pass between the first paddle 250 and the base 200. The second paddle 270 may couple to the second pivot 218 such that the second paddle 270 may pivot between the closed position 298 and the open position 296. The second pivot 218 may comprise the second base aperture 220 to allow the moist air to pass between the second paddle 270 and the base 200.

The control ring 238 may be coupled to the operational control 208 and may be movably coupled to the base 200. The control ring 238 may be adapted to be accessible to the user 950 on the exterior of the base 200 such that the user 950 may adjust the operational control 208 by moving the control ring 238. The control ring 238 may comprise an off position 240, a low position 242, a medium position 244, and a high position 246. The control ring 238 may be moved to the off position 240 to de-energize the cooling fan 206, the heating fan 204, and the heating element 202. The control ring 238 may be moved to the low position 242, the medium position 244, or the high position 246 to energize the cooling fan 206, the heating fan 204, and the heating element 202. The control ring 238 may be moved to the low position 242 to select the slowest rotational speed of the cooling fan 206, the slowest rotational speed of the heating fan 204, the lowest degree of heating of the heating element 202, or combinations thereof. The control ring 238 may be moved to the high position 246 to select the fastest rotational speed of the cooling fan 206, the fastest rotational speed of the heating fan 204, the highest degree of heating of the heating element 202, or combinations thereof.

The first paddle 250 may comprise a first paddle interface 252, a first plurality of ridges 256, and a first plurality of troughs 262. The first paddle 250 may be a hollow housing that may direct the flow of the heated air. The first paddle 250 may narrow to the first paddle interface 252 at the proximal end 300 where the first paddle 250 couples to the base 200 via the first pivot 214. The first paddle interface 252 may comprise a first paddle aperture 254 which may admit the heated air into the first paddle 250. The first paddle 250 may widen at the distal end 310. The first paddle 250 may comprise the first face 266. The first face 266 may be located on the side of the first paddle 250 that is adjacent to the second paddle 270 when the first paddle 250 and the second paddle 270 are in the closed position 298. The first face 266 may comprise the first plurality of ridges 256 and the first plurality of troughs 262. The first plurality of ridges 256 and the first plurality of troughs 262 may be oriented to run from the distal end 310 of the first face 266 to the proximal end 300 of the first face 266 and the first plurality of ridges 256 may alternate with the first plurality of troughs 262. The first plurality of ridges 256 may comprise a plurality of nozzles 258. The plurality of nozzles 258 may be extensions of the surface of the first plurality of ridges 256. The plurality of nozzles 258 may comprise a plurality of nozzle apertures 260. The heated air may exit the first paddle 250 via the plurality of nozzle apertures 260. The plurality of nozzles 258 may direct the heated air towards the second paddle 270.

The second paddle 270 may comprise a second paddle interface 272, a second plurality of ridges 276, and a second plurality of troughs 282. The second paddle 270 may be a hollow housing that may direct the flow of the moist air. The second paddle 270 may narrow to the second paddle interface 272 at the proximal end 300 where the second paddle 270 couples to the base 200 via the second pivot 218. The second paddle interface 272 may comprise a second paddle aperture 274 which may admit the moist air into the second paddle 270. The second paddle 270 may widen at the distal end 310. The second paddle 270 may comprise the second face 286. The second face 286 may be located on the side of the second paddle 270 that is adjacent to the first paddle 250 when the first paddle 250 and the second paddle 270 are in the closed position 298. The second face 286 may comprise the second plurality of ridges 276 and the second plurality of troughs 282. The second plurality of ridges 276 and the second plurality of troughs 282 may be oriented to run from the distal end 310 of the second face 286 to the proximal end 300 of the second face 286 and the second plurality of ridges 276 may alternate with the second plurality of troughs 282. The second plurality of troughs 282 may comprise a plurality of trough apertures 284. The second paddle 270 may draw the moist air in through the plurality of trough apertures 284.

The first face 266 on the first paddle 250 and the second face 286 on the second paddle 270 may be organized such that the first plurality of ridges 256 on the first paddle 250 may align with the second plurality of troughs 282 on the second paddle 270 and the first plurality of troughs 262 on the first paddle 250 may align with the second plurality of ridges 276 on the second paddle 270. Thus, the first plurality of ridges 256 on the first paddle 250 may be interspersed between the second plurality of ridges 276 on the second paddle 270 when the first paddle 250 and the second paddle 270 are in the closed position 298.

The plurality of nozzle apertures 260 on the first paddle 250 and the plurality of trough apertures 284 on the second paddle 270 may be organized such that the plurality of nozzle apertures 260 align with the plurality of trough apertures 284 such that the heated air may exit the plurality of nozzle apertures 260, may pass through the hair 900, and may enter the plurality of trough apertures 284 as the moist air.

Figure 4A:
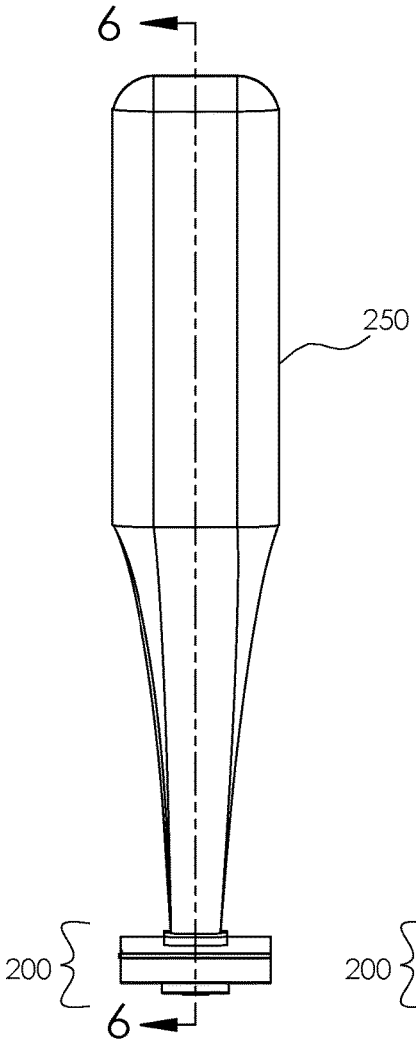
FIG. 4A is a front view of an embodiment of the disclosure.
Figure 4B:
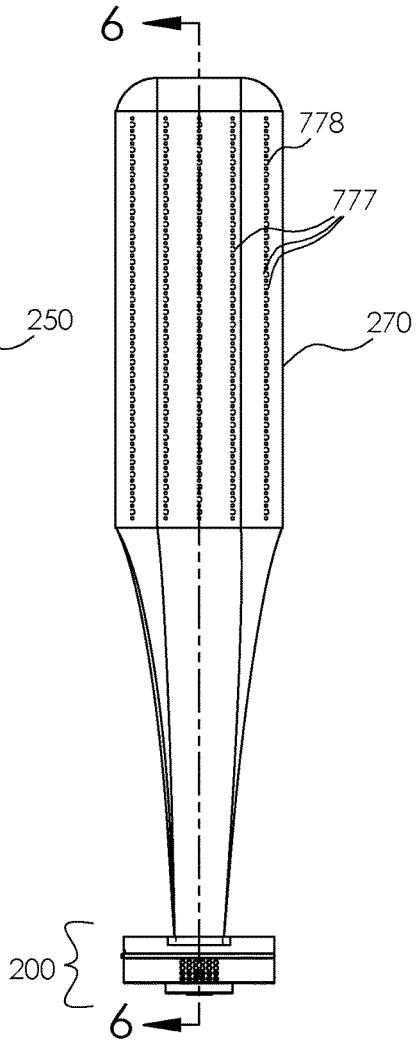
FIG. 4B is a front view of a second embodiment of the disclosure.
Figure 5A:
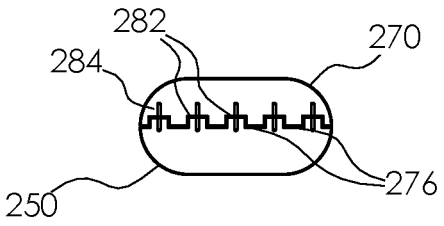
FIG. 5A is a cross-sectional view of an embodiment of the disclosure across 5-5 as shown in FIG. 3.
Figure 5B:
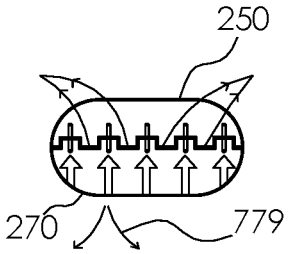
FIG. 5B is a cross-sectional view of a second embodiment of the disclosure across 5-5 as shown in FIG. 3.
Figure 6:
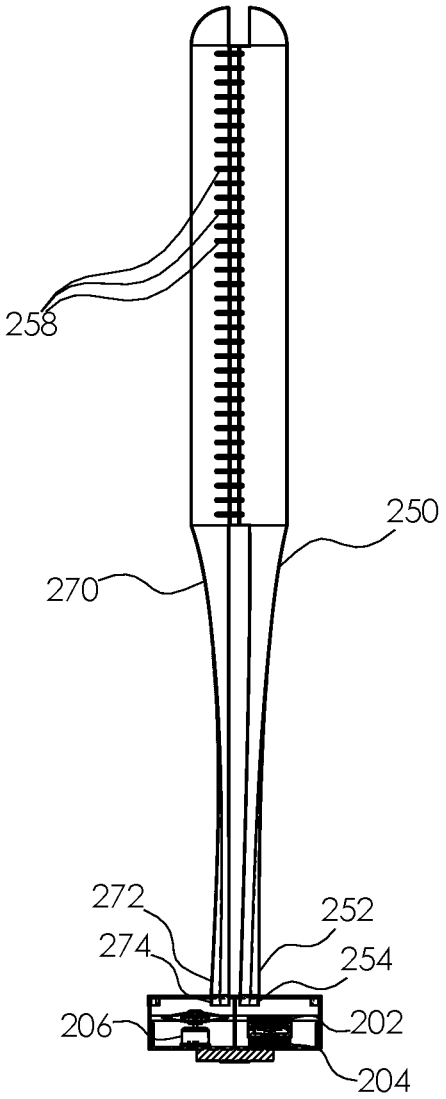
FIG. 6 is a cross-sectional view of an embodiment of the disclosure across 6-6 as shown in FIG. 4.
Figure 7:
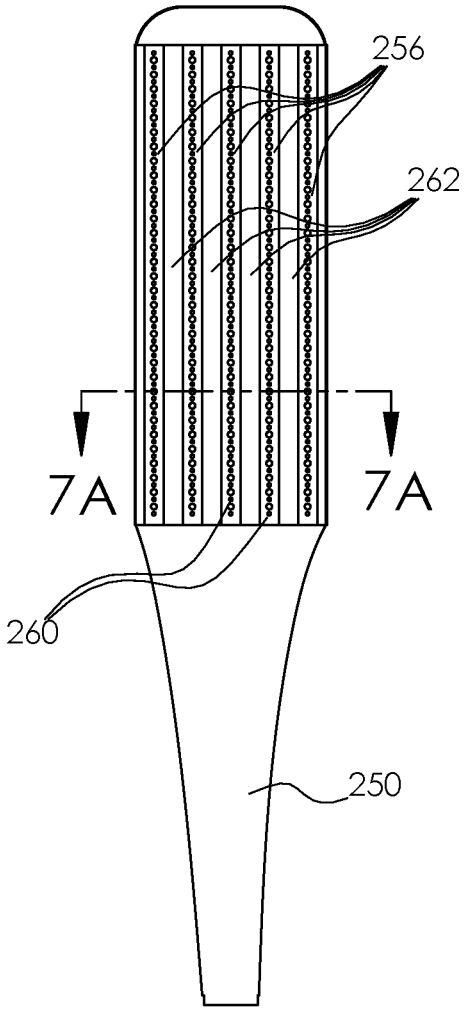
FIG. 7 is a detail of an embodiment of the disclosure illustrating the first paddle.
Figure 7A:
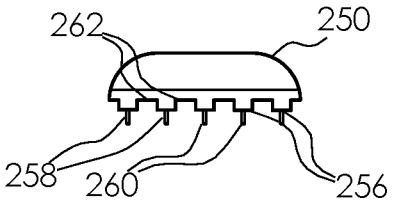
FIG. 7A is a cross-sectional view of an embodiment of the disclosure across 7A-7A as shown in FIG. 7.
Figure 8:
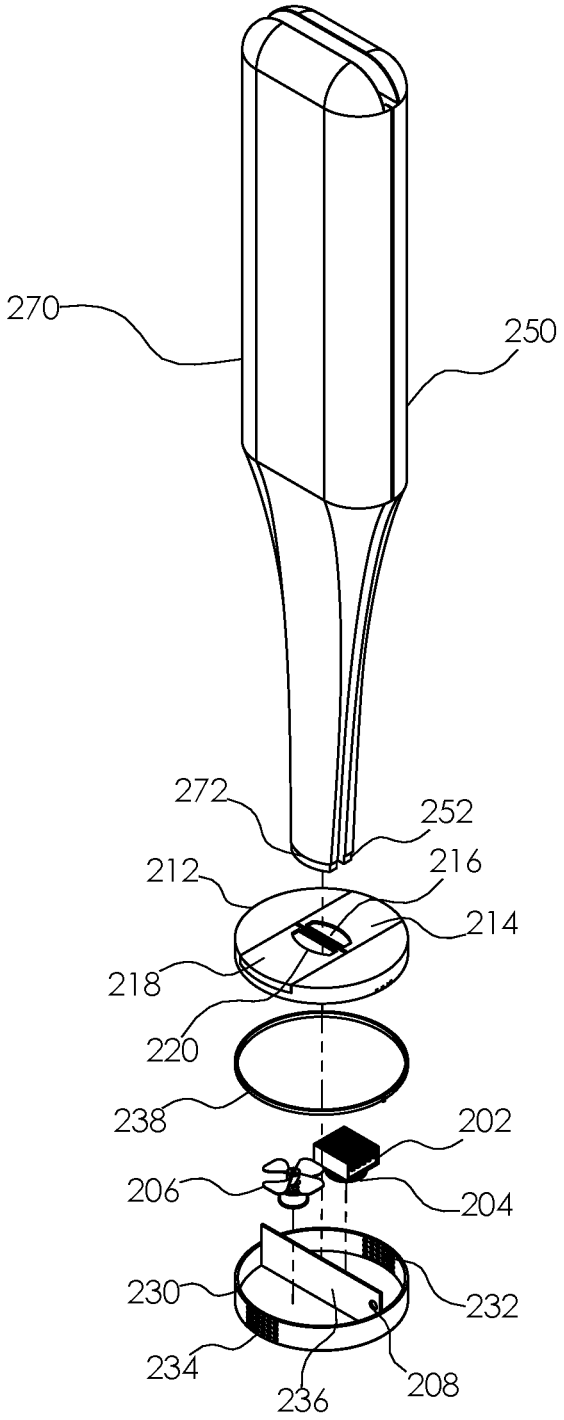
FIG. 8 is an exploded view of an embodiment of the disclosure.
Figure 9:
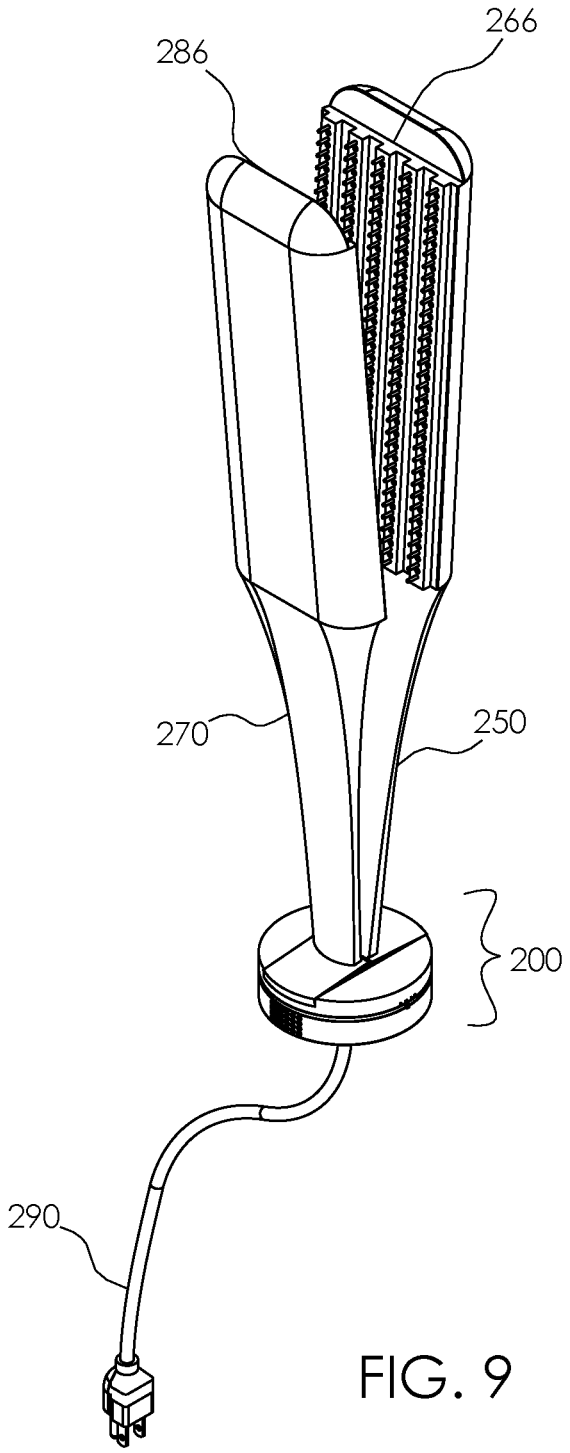
FIG. 9 is an in-use view of an embodiment of the disclosure illustrating the paddles in the open position.
Figure 10:
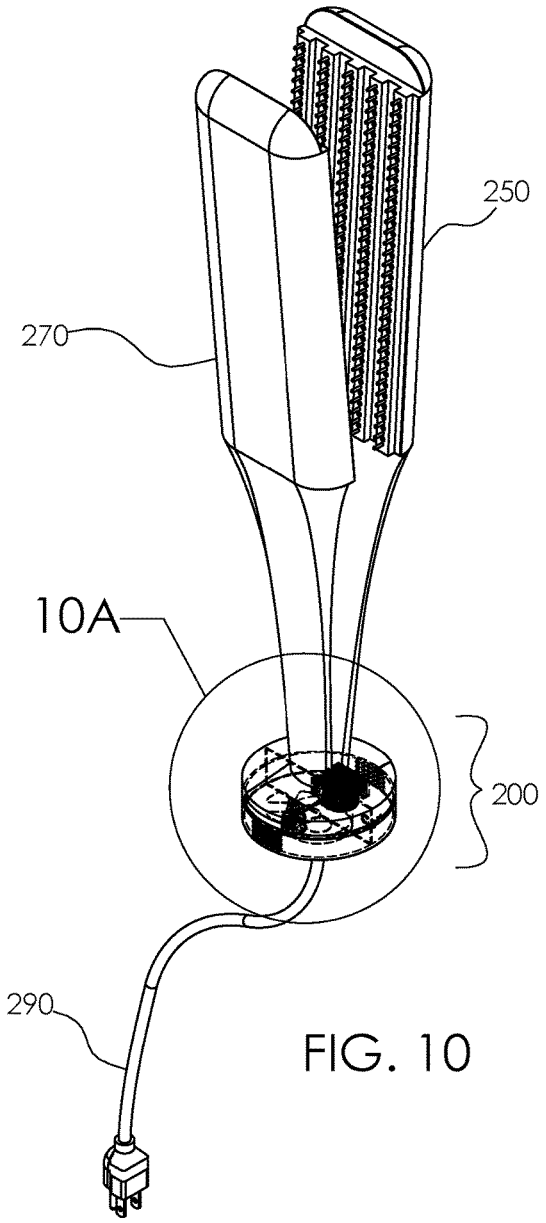
FIG. 10 is an in-use view of an embodiment of the disclosure illustrating the paddles in the open position and alignment of elements in the base.
Figure 10A:
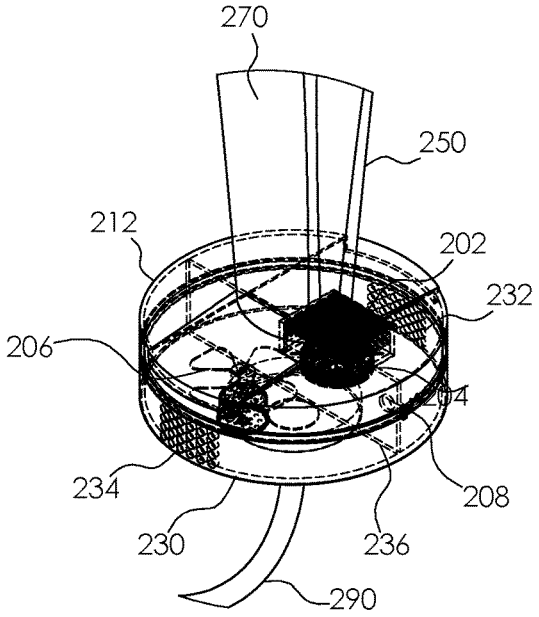
FIG. 10A is a detail view of an embodiment of the disclosure illustrating the area marked 10A in FIG. 10.
Figure 11:
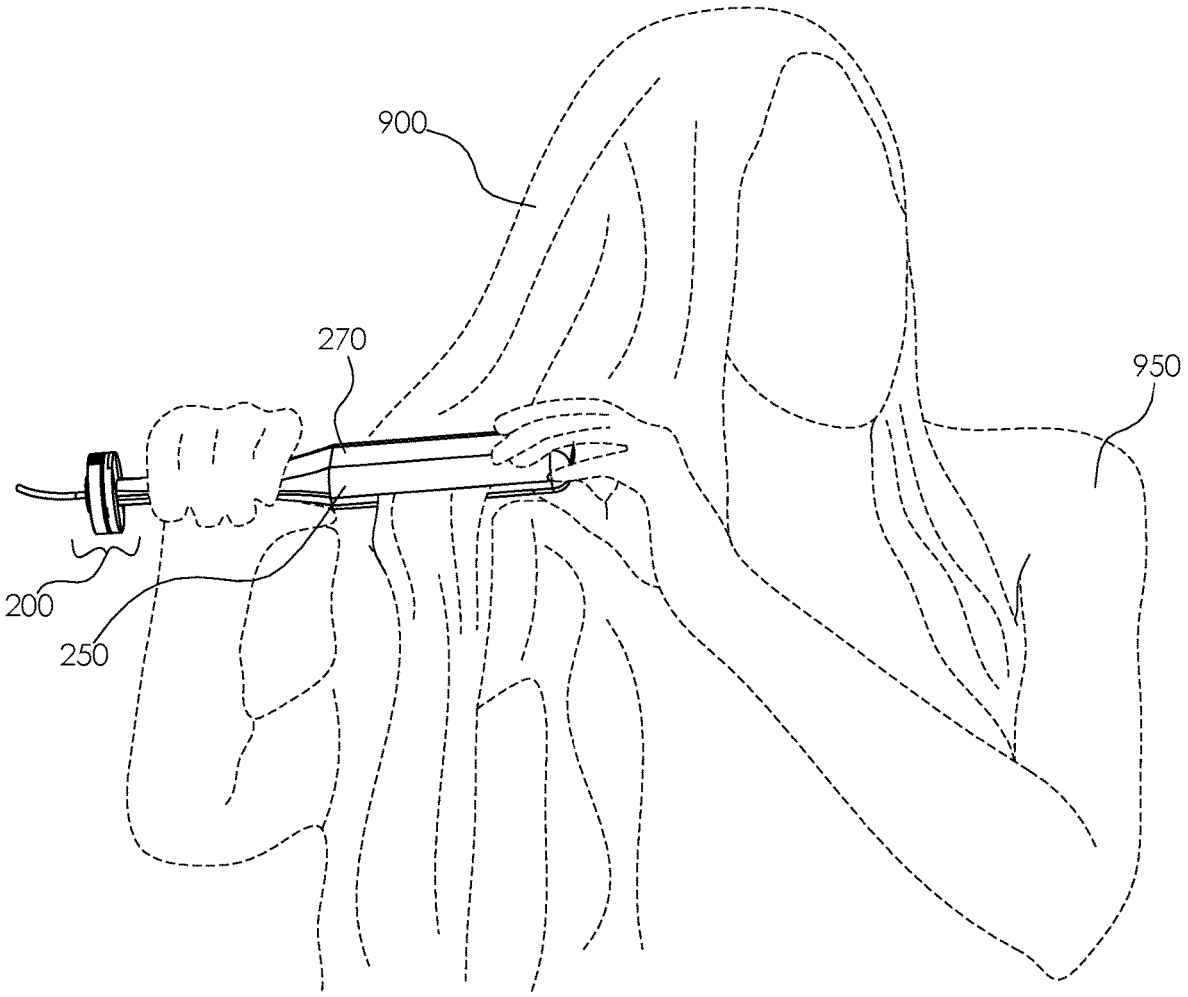
FIG. 11 is an in-use view of an embodiment of the disclosure illustrating the hair in place to be dried.

Referring to FIGS. 4B and 5B, the second paddle 270 has a plurality of holes 777 provided on an outer surface 778 of the second paddle 270. This enables the moist heated air 779 to exit into the atmosphere directly, and with no need fora vacuum or use of the air exhaust port 234 in the base 200.

The invention 100 may be powered from an external power source such as a wall outlet via a power cord 290.

In use, the invention 100 may be plugged into a power source using the power cord 290 and the control ring 238 may be moved to the low position 242, the medium position 244, or the high position 246. The first paddle 250 and the second paddle 270 may be moved to the open position 296. The hair 900 may be placed between the first paddle 250 and the second paddle 270. The first paddle 250 and the second paddle 270 may be moved to the closed position 298. The ambient air may be drawn into the base 200 via the air intake port 232 by the heating fan 204 and heated by the heating element 202. The heated air may be forced through the first paddle 250 and expelled from the first paddle 250 via the plurality of nozzle apertures 260. The heated air may pass through the hair 900. The moist air may be pulled into the second paddle 270 via the plurality of trough apertures 284 by the cooling fan 206. The moist air may pass through the second paddle 270 and may be expelled from the base 200 via the air exhaust port 234.

Definitions

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface. Aperture may be synonymous with hole, slit, crack, gap, slot, or opening.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "energize" and/or "energization" refer to the application of an electrical potential to a system or subsystem.

As used in this disclosure, the word "exterior" may be used as a relational term that implies that an object is not located or contained within the boundary of a structure or a space.

As used in this disclosure, a "fan" may be a mechanical device with rotating blades that is used to create a flow or current of air.

As used in this disclosure, a "heating element" may be a resistive wire that is used to convert electrical energy into heat. As non-limiting examples, common metals used to form heating elements include a combination of nickel and chromium, a combination of iron, chromium and aluminum, a combination of copper, nickel, iron, and manganese, or platinum.

As used in this disclosure, a "housing" may be a rigid or semi-rigid casing that encloses and protects one or more devices.

As used in this disclosure, an "interface" may be a physical or virtual boundary that separates two different systems and across which information is exchanged.

As used in this disclosure, the word "interior" may be used as a relational term that implies that an object is located or contained within the boundary of a structure or a space.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

With respect to the above description, it is to be realized that the optimum dimensional relationship for the various components of the invention described above and in FIGS. 1 through 11, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hair dryer blower comprising:

a base, a first paddle, and a second paddle;

wherein the hair dryer blower dries hair;

wherein the first paddle and the second paddle are moved to an open position and the hair is placed between the first paddle and the second paddle;

wherein the first paddle and the second paddle are pivoted to a closed position such that a first face on the first paddle is brought adjacent to a second face on the second paddle with the hair passing between the first paddle and the second paddle;

wherein a heating fan located within the base draws ambient air across a heating element and forces heated air out of the first paddle and through the hair;

wherein the heated air passes through the hair and dries the hair;

wherein moist air produced as the heated air passes through the hair enters the second paddle;

wherein the moist air is drawn through the second paddle by a cooling fan in the base and is expelled via an air exhaust port.

2. The hair dryer blower according to claim 1 wherein the base comprises the heating element, the heating fan, the cooling fan, an operational control, and an enclosure;

wherein the base is pivotably coupled to a proximal end of the first paddle via a first pivot and is pivotably coupled to the proximal end of the second paddle via a second pivot.

3. The hair dryer blower according to claim 2 wherein the heating element converts electrical energy into heat;

wherein the amount of heating produced by the heating element varies based upon one or more characteristics of the electrical energy applied to the heating element;

wherein the heating element is located inside of the enclosure and oriented such that the ambient air is pulled across the heating element by the cooling fan and produces the heated air that is forced into the first paddle.

4. The hair dryer blower according to claim 3 wherein the heating fan is mounted inside of the enclosure;

wherein the heating fan forces the movement of the ambient air;

wherein the heating fan is electromechanical in nature.

5. The hair dryer blower according to claim 4 wherein the heating fan is a fan or a blower;

wherein the heating fan draws the ambient air in through an air intake port;

wherein the heating fan pulls the ambient air across the heating element thus creating the heated air;

wherein the heating fan expels the heated air from the base into the first paddle via a first base aperture.

6. The hair dryer blower according to claim 5 wherein the cooling fan is mounted inside of the enclosure;

wherein the cooling fan forces the movement of the moist air;

wherein the cooling fan is electromechanical in nature.

7. The hair dryer blower according to claim 6 wherein the cooling fan is a fan or a blower;

wherein the cooling fan draws the moist air in through a second base aperture;

wherein the cooling fan expels the moist air via the air exhaust port.

8. The hair dryer blower according to claim 7 wherein a divider separates air paths within the base such that the flow of the moist air through the base from the second paddle to the air exhaust port is segregated from the flow of the ambient air into the air intake port of the base, across the heating element, and into the first paddle as the heated air.

9. The hair dryer blower according to claim 8 wherein the operational control is an electrical control that determines whether or not electrical energy reaches the heating fan, the cooling fan and the heating element;

wherein the operational control comprises one or more speed settings;

wherein the operational control determines the speed of the heating fan, the speed of the cooling fan, the degree of heating of the heating element, or combinations thereof.

10. The hair dryer blower according to claim 9 wherein the enclosure comprises a fan holder, a fan cover, and a control ring;

wherein the enclosure houses and protects the cooling fan, the heating fan, the heating element, and the operational control.

11. The hair dryer blower according to claim 10 wherein the fan holder is the proximal end of the base;

wherein the cooling fan, the heating fan, and the heating element are coupled to the interior of the fan holder;

wherein a distal end of the fan holder is open when not covered by the fan cover;

wherein the fan holder comprises the divider, the air intake port, and the air exhaust port;

wherein the air intake port is one or more apertures in the fan holder located on the side of the fan holder that feeds the heated air into the first paddle;

wherein the air exhaust port is one or more apertures in the fan holder located on the side of the fan holder that draws the moist air from the second paddle.

12. The hair dryer blower according to claim 11 wherein the fan cover couples to the distal end of the fan holder to seal the fan holder;

wherein the fan cover comprises the first pivot and the second pivot;

wherein the first paddle couples to the first pivot such that the first paddle pivots between the closed position and the open position;

wherein the first pivot comprises the first base aperture to allow the heated air to pass between the first paddle and the base;

wherein the second paddle couples to the second pivot such that the second paddle pivots between the closed position and the open position;

wherein the second pivot comprises the second base aperture to allow the moist air to pass between the second paddle and the base.

13. The hair dryer blower according to claim 12 wherein the control ring is coupled to the operational control and is movably coupled to the base;

wherein the control ring is adapted to be accessible to a user on the exterior of the base such that the user adjusts the operational control by moving the control ring;

wherein the control ring comprises an off position, a low position, a medium position, and a high position;

wherein the control ring is moved to the off position to de-energize the cooling fan, the heating fan, and the heating element;

wherein the control ring is moved to the low position, the medium position, or the high position to energize the cooling fan, the heating fan, and the heating element;

wherein the control ring is moved to the low position to select the slowest rotational speed of the cooling fan, the slowest rotational speed of the heating fan, the lowest degree of heating of the heating element, or combinations thereof;

wherein the control ring is moved to the high position to select the fastest rotational speed of the cooling fan, the fastest rotational speed of the heating fan, the highest degree of heating of the heating element, or combinations thereof.

14. The hair dryer blower according to claim 13 wherein the first paddle comprises a first paddle interface, a first plurality of ridges, and a first plurality of troughs;

wherein the first paddle is a hollow housing that directs the flow of the heated air;

wherein the first paddle narrows to the first paddle interface at the proximal end where the first paddle couples to the base via the first pivot;

wherein the first paddle interface comprises a first paddle aperture which admits the heated air into the first paddle;

wherein the first paddle widens at the distal end;

wherein the first paddle comprises the first face;

wherein the first face is located on the side of the first paddle that is adjacent to the second paddle when the first paddle and the second paddle are in the closed position;

wherein the first face comprises the first plurality of ridges and the first plurality of troughs;

wherein the first plurality of ridges and the first plurality of troughs are oriented to run from the distal end of the first face to the proximal end of the first face and the first plurality of ridges alternate with the first plurality of troughs;

wherein the first plurality of ridges comprise a plurality of nozzles;

wherein the plurality of nozzles are extensions of the surface of the first plurality of ridges;

wherein the plurality of nozzles comprise a plurality of nozzle apertures;

wherein the heated air exits the first paddle via the plurality of nozzle apertures;

wherein the plurality of nozzles direct the heated air towards the second paddle.

15. The hair dryer blower according to claim 14 wherein the second paddle comprises a second paddle interface, a second plurality of ridges, and a second plurality of troughs;

wherein the second paddle is a hollow housing that directs the flow of the moist air;

wherein the second paddle narrows to the second paddle interface at the proximal end where the second paddle couples to the base via the second pivot;

wherein the second paddle interface comprises a second paddle aperture which admits the moist air into the second paddle;

wherein the second paddle widens at the distal end;

wherein the second paddle comprises the second face;

wherein the second face is located on the side of the second paddle that is adjacent to the first paddle when the first paddle and the second paddle are in the closed position;

wherein the second face comprises the second plurality of ridges and the second plurality of troughs;

wherein the second plurality of ridges and the second plurality of troughs are oriented to run from the distal end of the second face to the proximal end of the second face and the second plurality of ridges alternate with the second plurality of troughs;

wherein the second plurality of troughs comprise a plurality of trough apertures;

wherein the second paddle draws the moist air in through the plurality of trough apertures.

16. The hair dryer blower according to claim 15 wherein the first face on the first paddle and the second face on the second paddle are organized such that the first plurality of ridges on the first paddle align with the second plurality of troughs on the second paddle and the first plurality of troughs on the first paddle align with the second plurality of ridges on the second paddle.

17. The hair dryer blower according to claim 16 wherein the plurality of nozzle apertures on the first paddle and the plurality of trough apertures on the second paddle are organized such that the plurality of nozzle apertures align with the plurality of trough apertures such that the heated air exits the plurality of nozzle apertures, passes through the hair, and enters the plurality of trough apertures as the moist air.

18. The hair dryer blower according to claim 14 wherein the second paddle comprises a second paddle interface, a second plurality of ridges, and a plurality of holes;

wherein the second paddle is a hollow housing that directs the flow of the moist air;

wherein the second paddle interface comprises a second paddle aperture which admits the moist air into the second paddle and out the plurality of holes into the atmosphere;

wherein the second paddle comprises the second face;

wherein the second face is located on the side of the second paddle that is adjacent to the first paddle when the first paddle and the second paddle are in the closed position;

wherein the second face comprises the second plurality of ridges and the second plurality of troughs;

wherein the second plurality of ridges and the second plurality of troughs are oriented to run from the distal end of the second face to the proximal end of the second face and the second plurality of ridges alternate with the second plurality of troughs;

wherein the second plurality of troughs comprise a plurality of trough apertures;

wherein the second paddle draws the moist air in through the plurality of trough apertures and directly to the plurality of holes.

19. The hair dryer blower according to claim 18 wherein the first face on the first paddle and the second face on the second paddle are organized such that the first plurality of ridges on the first paddle align with the second plurality of troughs on the second paddle and the first plurality of troughs on the first paddle align with the second plurality of ridges on the second paddle.

* * * * *